US006097142A

United States Patent [19]

Ko

[11] Patent Number: 6,097,142

[45] Date of Patent: Aug. 1, 2000

[54] SHADOW MASK HAVING AN EFFECTIVE FACE AREA AND INEFFECTIVE FACE AREA

[75] Inventor: Sung-Woo Ko, Inchon-kwangyokshi, Rep. of Korea

[73] Assignee: LG Electronics Inc., Seoul, Rep. of Korea

[21] Appl. No.: 08/968,945

[22] Filed: Nov. 12, 1997

[30] Foreign Application Priority Data

Nov. 13, 1996 [KR] Rep. of Korea ..... 96-53634

[51] Int. Cl.[7] ..... H01J 29/80

[52] U.S. Cl. ..... 313/402; 313/403; 313/407

[58] Field of Search ..... 313/402, 403, 313/408, 407; 445/37, 47, 49

[56] References Cited

U.S. PATENT DOCUMENTS 4,746,315 5/1988 Sumiyoshi ..... 445/37

5,616,985 4/1997 Hosotani ..... 313/403

*Primary Examiner*—Nimeshkumar D. Patel
*Assistant Examiner*—Joseph Williams
*Attorney, Agent, or Firm*—Finnegan, Henderson, Farabow, Garrett & Dunner, L.L.P.

[57] ABSTRACT

A stress reduction shadow mask of the present invention distributes the tension evenly across the entire surface so that a greater force may be applied to stretch the mask. The shadow mask comprises an effective face area constituting a central portion of the shadow mask. The effective face area has electron beam apertures, which electrons pass through. A secondary ineffective face area surrounds the effective face area and also has apertures. A frame attaching border further surrounds the secondary ineffective face area, and a primary ineffective face area at least partially surrounds the frame attaching border. Corners of the shadow are adjacent the primary ineffective face area and do not have apertures. Portions of the primary and/or secondary ineffective areas are treated with tie bar grading and/or have round corners. The mask is stretched under tension and attached to the frame at the frame attaching border while under tension.

61 Claims, 6 Drawing Sheets

SHADOW MASK HAVING AN EFFECTIVE FACE AREA AND INEFFECTIVE FACE AREA

BACKGROUND OF THE INVENTION

A. Field of the Invention

The present invention relates to a flat color cathode ray tube (hereinafter referred to as "CRT"). More particularly, it relates to a shadow mask for a flat CRT that prevents an electron beam from mislanding when kinetic energy of the electron is converted into heat energy when colliding with the shadow mask, and then the mask expands with heat during operation of the CRT.

B. Description of the Prior Art

As shown in FIGS. 1 and 2, a conventional flat CRT comprises a safety glass 1 bonded to the front of a flat panel 2 with a resin in order to maintain an explosion-proof characteristic; a funnel 3 attached to panel 2 by a glass frit; an electron gun 5 being encased in the neck 3*a* of funnel 3 for emitting R, G, and B electron beams 4; a shadow mask 7 behind panel 2 and having innumerable slit-shaped apertures for selecting the color of the electron beam; and a frame 6 supporting in order to maintain a constant distance between the shadow mask 7 and the panel 2.

As illustrated in FIG. 3, the shadow mask 7 has an effective face area 10, which is the electron beam landing area; and an area 11, where apertures are not formed; and an ineffective face area 12, which is not used in practice. Line 13 refers to the position where frame 6 is attached.

The electron beams 4, emitted from the electron gun 5, pass through electron beam apertures 7' in the shadow mask 7, before colliding with a phosphor screen (not shown) applied to the inner surface of the panel 2. Kinetic energy of the electron beams 4 causes multiple phosphors to emit light so that an image is displayed on the panel 2. Only 20% of the electrons pass through the electron beam apertures 7' of the shadow mask 7, the rest collide with shadow mask 7, and then are converted into heat so that the shadow mask 7 expands from the heat. Such a phenomenon is called "doming."

The position where the electron beams land on the phosphor screen is changed by the doming phenomenon, and therefore degradation of color purity is caused. In order to solve this problem, an INVAR mask, which has a low coefficient of thermal expansion has been used. Another approach is to use a bimetal as a spring for fixing the shadow mask at the panel. However, the cost of manufacture is increased, and operation efficiency is deteriorated.

A flat foil tension mask (hereinafter referred to as "tension mask") is designed to enhance definition in recent years. Because tension is applied to the tension mask, it compensates for expansion due to heat caused by electrons colliding against the mask. As a result, the position where the apertures are formed in the mask is not changed as even at high temperature.

The tension mask is assembled inside the front of the CRT, adjacent to the flat panel, and is fastened to a support fixing the mask so that electrons land on their geometrically intended phosphor dots on the inner surface of the panel. The tension mask, with a thickness of 0.025 mm is disposed at a fixed distance from the inner surface of the panel, and is a color selection device for selecting the electron beams and causing the phosphor screen, coated with red, green, and blue phosphors, to emit light in accordance with the corresponding signal.

Such a tension mask has dot-shaped electron beams apertures, and thus, Young's moduli in the horizontal and vertical directions are about the same. As a result, the effective face area can be uniform and considerable tension can be applied.

Recently, a mask with slit-shaped apertures has been employed to enhance screen characteristics such as definition, wave patterns on the screen, and purity redundancy. However, there is a large difference in Young's moduli between the horizontal and vertical directions, and the effective face area is not uniform and less tension can be applied. If little strain is applied, the electron mislands due to expansion of the mask. If much strain is applied, stress is concentrated on certain regions of the mask so that the plastic deformation occurs, deforming or breaking the mask.

In order to solve these problems, apertures are formed around the circumference of the effective face area of the mask. As shown in FIG. 4, the electron beam apertures are formed in the ineffective face area A in order to produce anisotropic elasticity. However, if much strain is applied, stress is concentrated in corner B of the ineffective face area, reducing the amount of tension that can be applied.

SUMMARY OF THE INVENTION

Accordingly, the present invention is directed to a shadow mask for a flat CRT that substantially obviate one or more of the problems, limitations, and disadvantages of the related art.

An objective of the present invention is to provide a stress reduction shadow mask in which the stress concentrated on a fixed region can be dispersed when the strain applied to the mask is increased, in order to uniformly disperse force for stretch all over the surface.

Additional objects and advantages of the invention will be set forth in part in the description which follows, and in part will be obvious from the description, or may be learned by practice of the invention. The objectives and advantages of the invention will be realized and attained by means of the elements and combinations particularly pointed out in the appended claims.

To achieve these and other advantages and in accordance with the purpose of the present invention, as embodied and broadly described, the shadow mask of the present invention comprises an effective face area having a plurality of apertures and constituting a central portion of the shadow mask for receiving electron beams. The mask further comprises a secondary ineffective face area having a plurality of apertures and surrounding the effective face area. The secondary ineffective face area receives no electron beams. The secondary ineffective face area is surrounded by a frame attaching border for attaching the shadow mask to a front panel of the cathode ray tube.

A further aspect of the invention includes a method of making a shadow mask comprising forming on the shadow mask an effective face area having a plurality of apertures and constituting a central portion of the mask for receiving electron beams. The method further comprises surrounding said effective face area with a secondary ineffective face area having a plurality of apertures, wherein the secondary ineffective face area receives no electron beams. The secondary ineffective face area is surrounded by a frame attaching border for attaching said shadow mask to a front panel of the cathode ray tube. The frame attaching border, in turn, is at least partially surrounded by a primary ineffective face area, wherein the primary ineffective face area receives no electron beams.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

BRIEF DESCRIPTION OF THE ATTACHED DRAWINGS

DETAILED DESCRIPTION OF PREFERRED EMBODIMENT

Reference will now be made in detail to the present preferred embodiments of the invention, examples of which are illustrated in the accompanying drawings.

Figure 1:
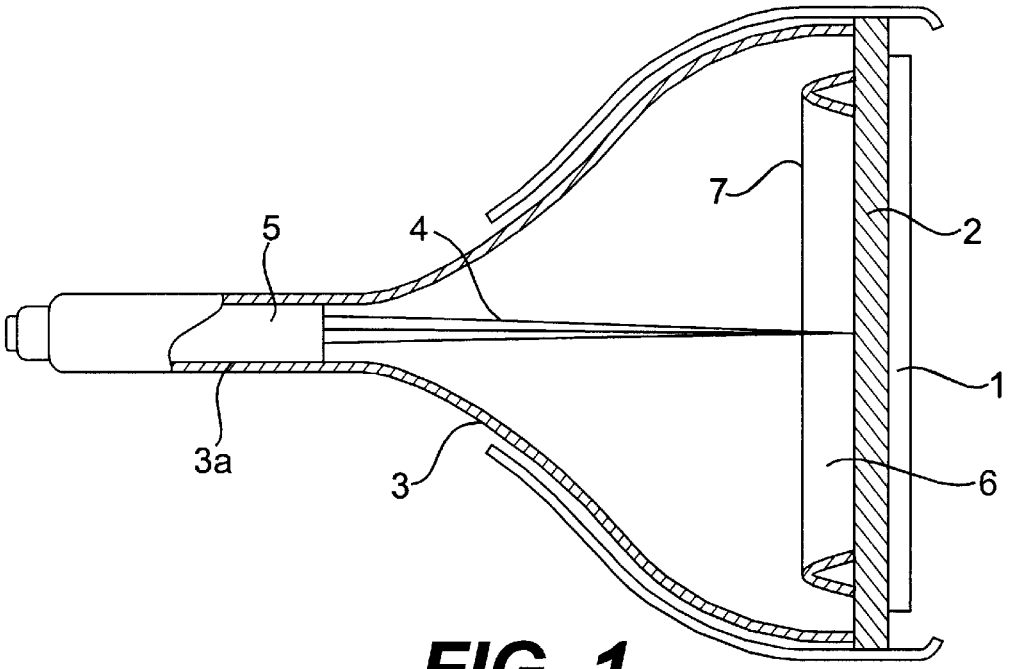
FIG. 1 PRIOR ART
FIG. 1 is a cross-section of a flat CRT.
Figure 2:
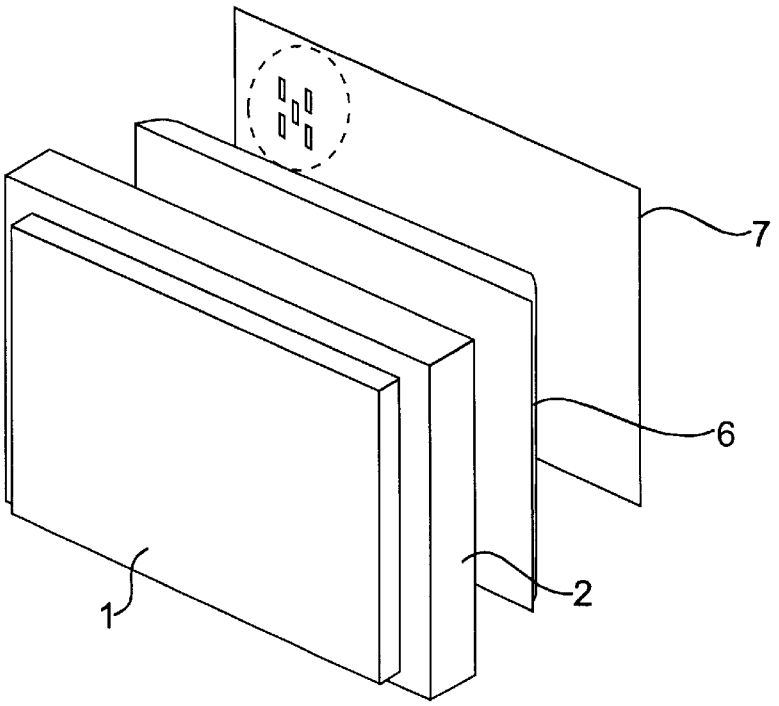
FIG. 2 PRIOR ART
FIG. 2 is an exploded perspective view of the panel portion of a flat CRT.
Figure 3:
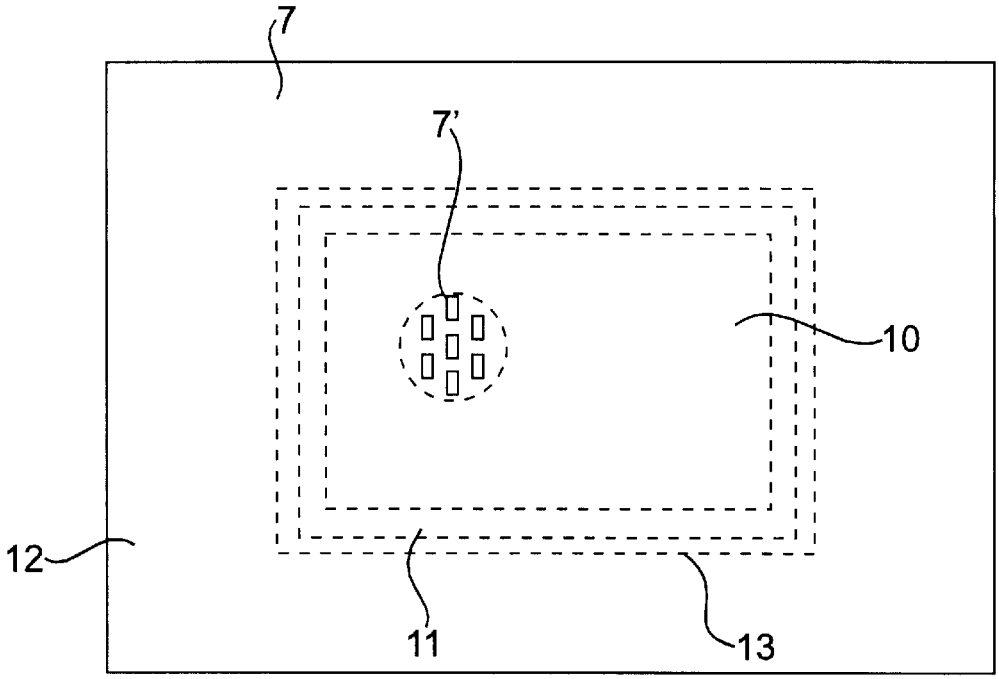
FIG. 3 PRIOR ART
FIG. 3 shows the structure of a conventional flat foil tension mask.
Figure 4:
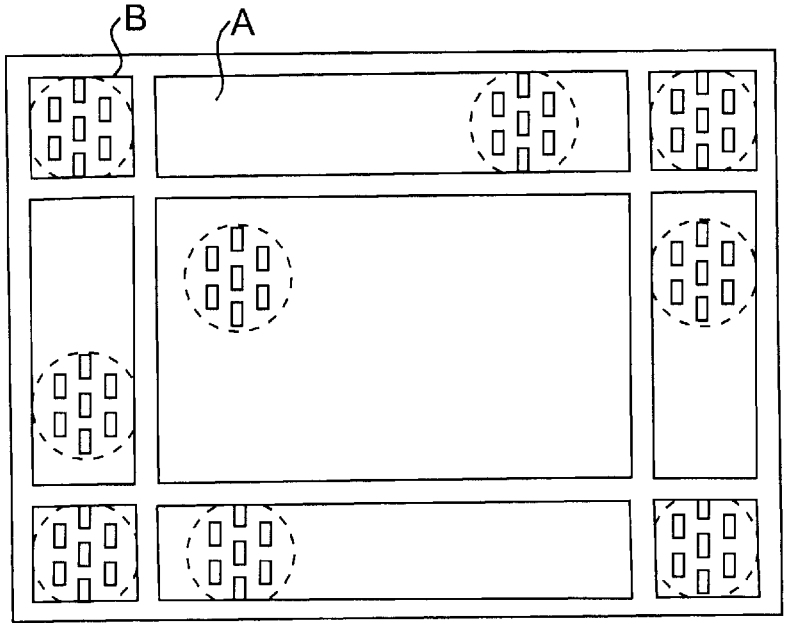
FIG. 4 PRIOR ART
FIGS. 4 and 5 show the structure of a conventional tension mask in which electron beam apertures are formed in the ineffective face area.
Figure 5:
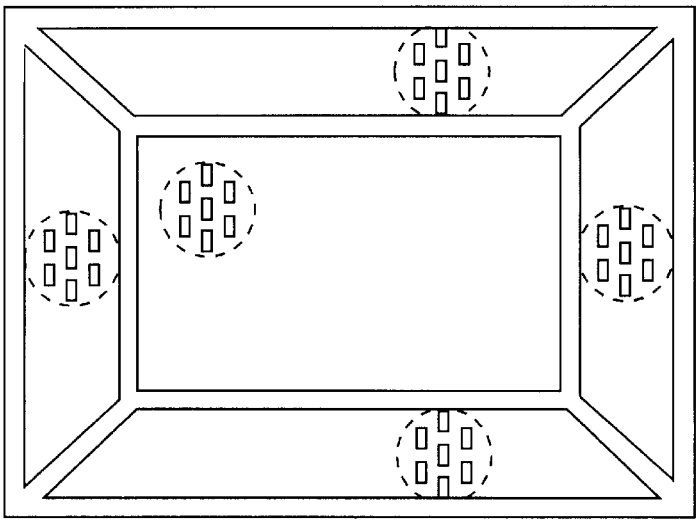
FIG. 5 PRIOR ART
Figure 6:
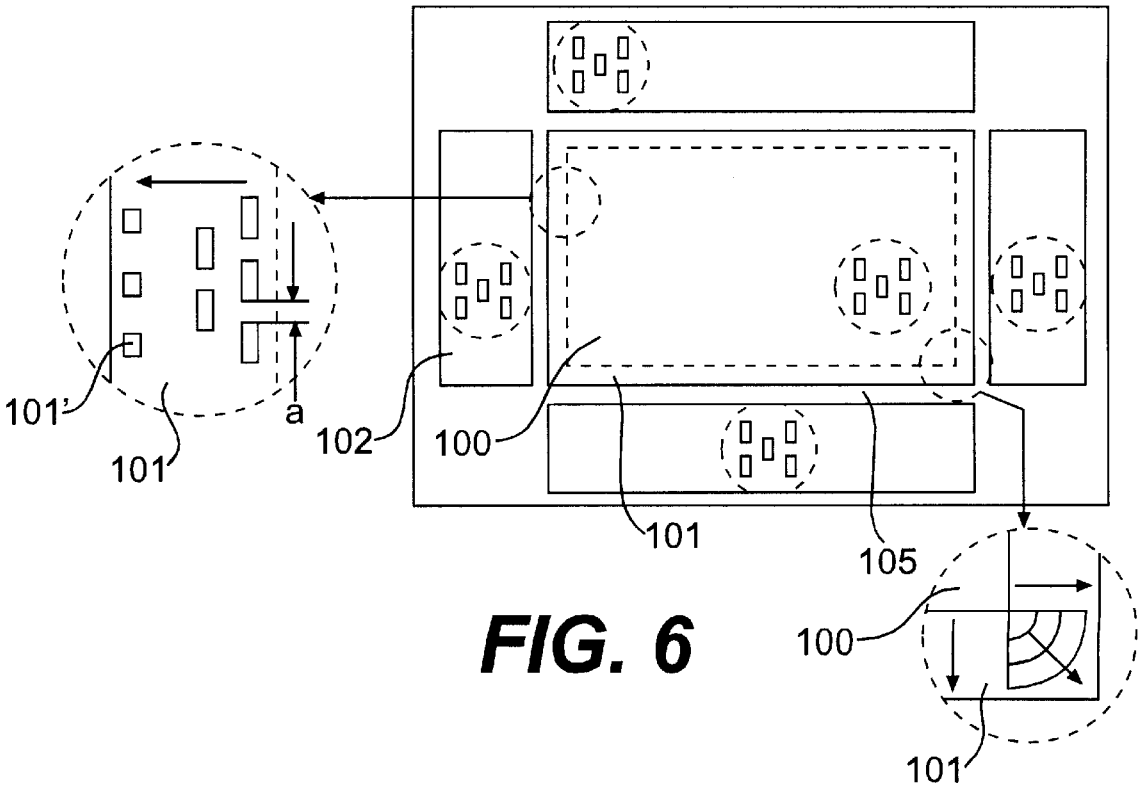
FIG. 6 shows the structure and a detail of a tension mask of the present invention.
Figure 8:
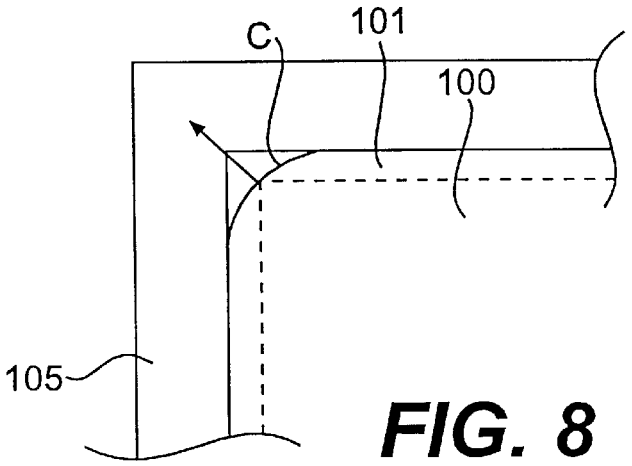
FIG. 8 shows the structure of a corner of an effective face area's extended region of the present invention.

As illustrated in FIG. 6, the tension mask has a secondary ineffective face area 101, extending from effective face area 100 of the center thereof, having electron beam apertures 101' and a tie bar distance ("a"), which is the distance between the apertures 101', that is graded in the direction of the arrow. That is, the distance between the apertures increases (or decreases) and the length of each aperture decreases (or increases) in the direction of the arrow. As illustrated in FIG. 8, the corners C of the extending region 101 treated with the tie bar grading in radial direction, are rounded.

Figure 7:
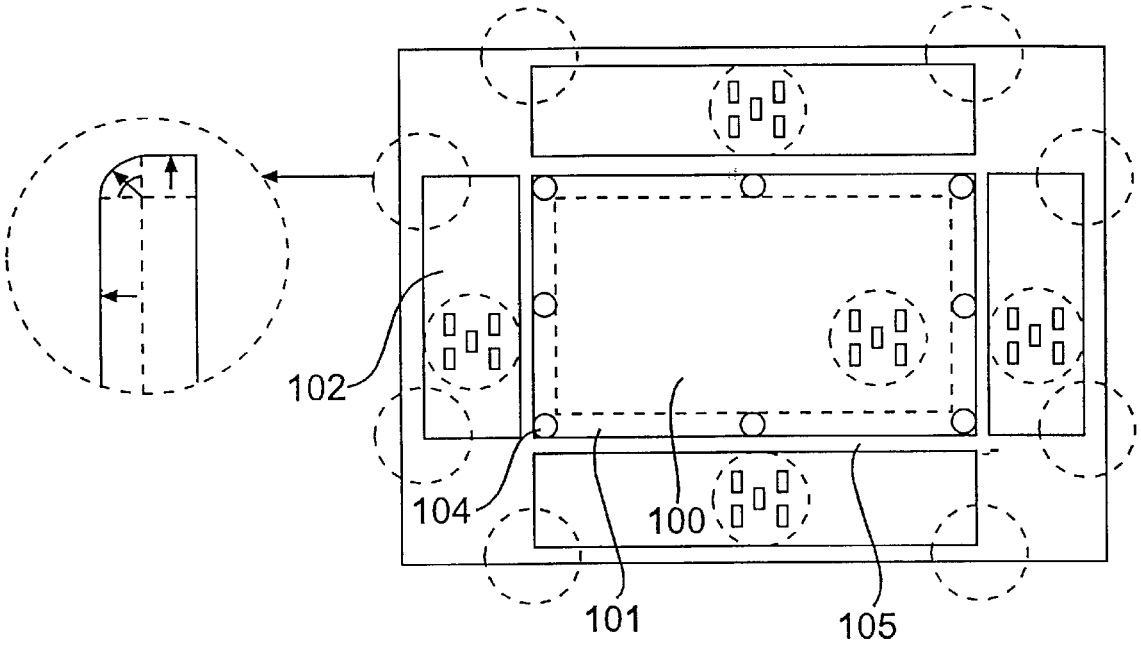
FIG. 7 shows the structure and a detail of a tension mask according to another preferred embodiment of the present invention.

As shown in FIGS. 6 through 11, a primary ineffective face area 102 is formed outside a frame fixing border in all directions except for corners of the mask. Outside regions of the primary ineffective face area 102 are treated with the tie bar grading in the directions indicated by the arrow in FIG. 10, and the corners of the primary ineffective face area 102 are rounded, and treated with the tie bar grading in the radial direction, as depicted in FIG. 7.

As shown in FIG. 7, three fiducial apertures 104 which are the standard to determine the stretch strain, are formed on each side of the secondary ineffective face area 101 which is the extending region of the effective face area 100.

Strain applied to the mask is the most important factor in preventing doming, and stress is directly related to it. The more the strain applied to the mask, the better. If overstressed, however, the mask might break.

Selection of specific strain value in the X direction and Y direction on the mask is an important technique. The effective face area is an important part of the extension of the mask which creates a correlation between strain and doming. It is essential to CRT that strain is uniformly applied, and consequently the displacement of the respective apertures should be uniform in line with the horizontal direction. The mask of the present invention has a structure in which the displacement of the respective apertures, in line with the horizontal direction, is uniform while considerable strain is applied, and the concentration of stress in a fixed region is removed, and the stress can be uniformly distributed.

A horizontal pitch is determined by grouping and degrouping of landing in accordance with the orbit of electron beams caused by a deflection yoke, vertical pitch is determined to prevent a moire pattern, and other specifications are determined from the viewpoint of definition and redundancy, thereby designing the effective face area 100 of the mask. However, the region outside the effective face area is formed to operate stably with larger values when tension is applied to the mask, regardless of the characteristic of the screen. The designing of such a region other than the effective face area is called a "mechanical mask design."

In applying a lot of strain on the tension mask, it must be noted that Young's moduli in the horizontal and vertical directions are different. These values vary according to the vertical pitch, the horizontal pitch, the slot width, the tie bar, etc. of the mask. Young's moduli of a 0:24 mm horizontal pitch, 0.339 mm vertical pitch mask, which is for high resolution, constructed from a plate with a thickness of 0.025 mm made of AK (Aluminum killed) steel, are given by $$E_x \sim 0.3\times10^5 \text{ (Mpa)}$$

$$E_y \sim 0.15\times10^6 \text{ (Mpa)}.$$

Young's modulus of Y direction being about five times that of X direction has a great effect upon the design of machine for stretching the mask, or the study on other characteristics of the mask. In a dot mask or a slit mask, particularly in a slit mask, the strain along each direction tends to localize at a fixed region and the region behaves with most of the strain. From this point of view, there may be a plastic deformation in the region controlling strain when too much stress is applied. If the mask is stressed within the plastic region, stress applied according to small force is changed substantially so that it is difficult to obtain the desired uniform displacement of the mask aperture.

Therefore, the mask should not be stressed beyond the elastic region, thus the maximum strain that can be applied is a screen characteristic determined by the aperture configuration of the effective face area. The design of a region around the circumference of the effective face area of the mask is required for applying the maximum of strain to the effective face area.

In manufacturing process of the CRT using a flat foil tension mask, it is important to stretch the mask by a strain being applied, before attaching it to the frame. For this, the mask is flattened by the force of a motor, with its edge held by grippers. The strain is concentrated at the corner of the effective face area of the mask, and in the present invention, the electron beam apertures 101 are formed in region 101 extending from the effective face area 100.

Even though the effective face area 100 extends 5–8 mm and the electron beam apertures 101' are formed, strain is still concentrated at the corners. The corners C can be rounded to remove the strain concentrated on the place where an angle is formed. In practice the corners can be rounded and the tie bar is increased in the diametric direction.

Because the extension of the effective face area 100 is insufficient for applying the maximum tension, the ineffective face area 102 is also formed with apertures around the circumference of the effective face area 100 in order to enhance the uniformity of Young's modulus and to promote stable deformation. That is to say, the strain uniformity is enhanced to remove strain concentrations when applying a lot of stress.

The corners of the ineffective face area 102 are rounded to reduce strain concentrations in the region outside of effective region 100. As shown in FIG. 7, the region with a proper edge width is selected and treated with the tie bar grading so that the value of Young's moduli is gradually changed between the region with apertures and the region without apertures.

Changing the value of Young's modulus means that because the electron beam apertures are in the shape of slit, much strain is applied around the tie bar located at the boundary between the apertures-formed and apertures-free regions. If the size of the apertures in this location is reduced, while maintaining the same amount of force than the force is applied over a greater area and the strain is reduced. Therefore, if the size of the apertures gradually increases, Young's modulus also gradually changes. Thus, in the areas where the tie bar grading is treated, the strain is stably compensated.

However, the tie bar grading is formed so that the corners are still exposed to stress. But the corners are rounded to solve this problem.

The slit mask operates in a unique way that strain stress of the vertical and horizontal directions behaves independently.

The behavior of the mask and the invention are described above, and the mask, the structure of the mask, a mask fixing device for assembly are discussed below.

When the mask in FIG. 7 is stretched with a certain machine or apparatus, the area under the maximum stress is the area where the force is applied.

Because stress is applied to the mask at the edge during the stretching of the mask, Young's modulus of the apertures-free region, between the effective face area and the region with apertures around the circumference of the effective face area, is relatively large at both sides so that there is no stress concentrations at the frame. This is because both sides, with the relatively small Young's modulus, are likely to strain exclusively. This is for the X direction. As for the Y direction, the change in Young's modulus of the Y direction is comparatively smooth. When the mask is attached to the mask frame at this state, the area where stress is applied to the mask is the apertures-free area between the effective face area and the ineffective face area, and then the strain is limited to this portion. This also applies to the Y direction.

Figure 9:
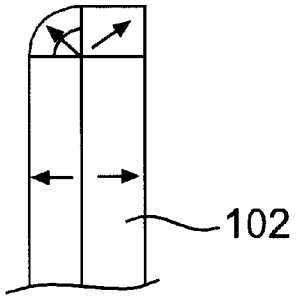
FIG. 9 shows the state of a tie bar grading of an ineffective face area of the present invention.
Figure 10:
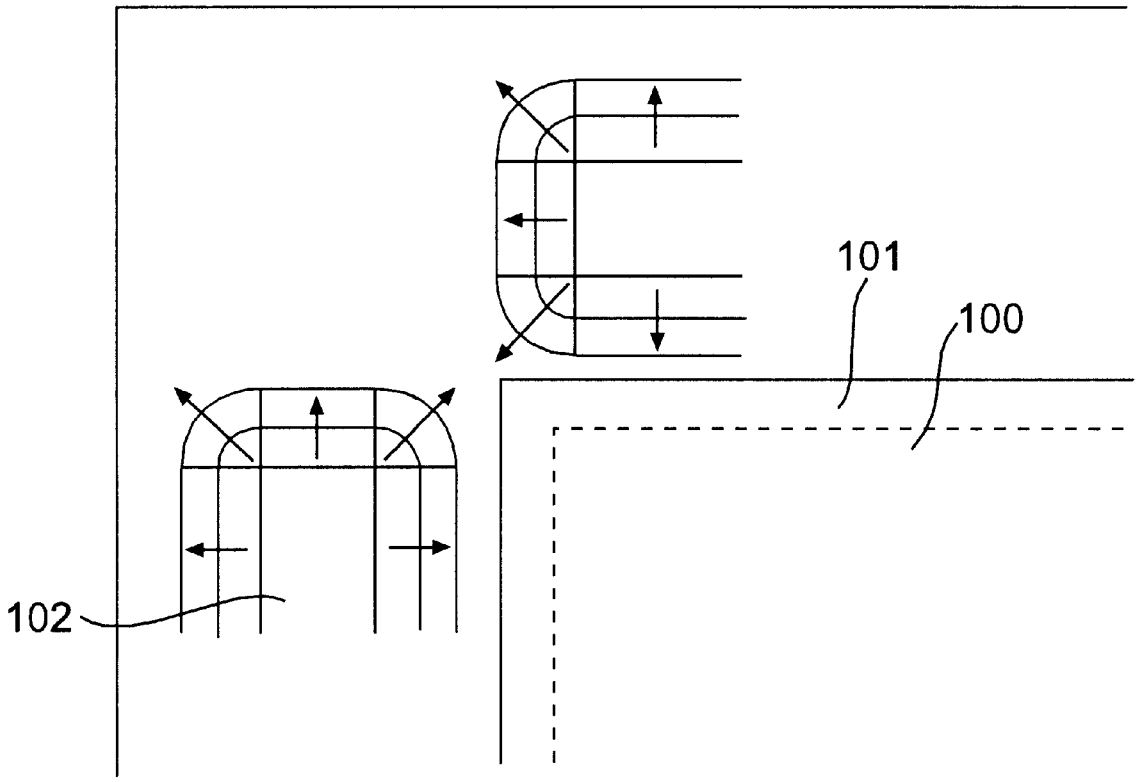
FIG. 10 shows a preferred embodiment of the tie bar grading of an ineffective face area of the present invention.
Figure 11:
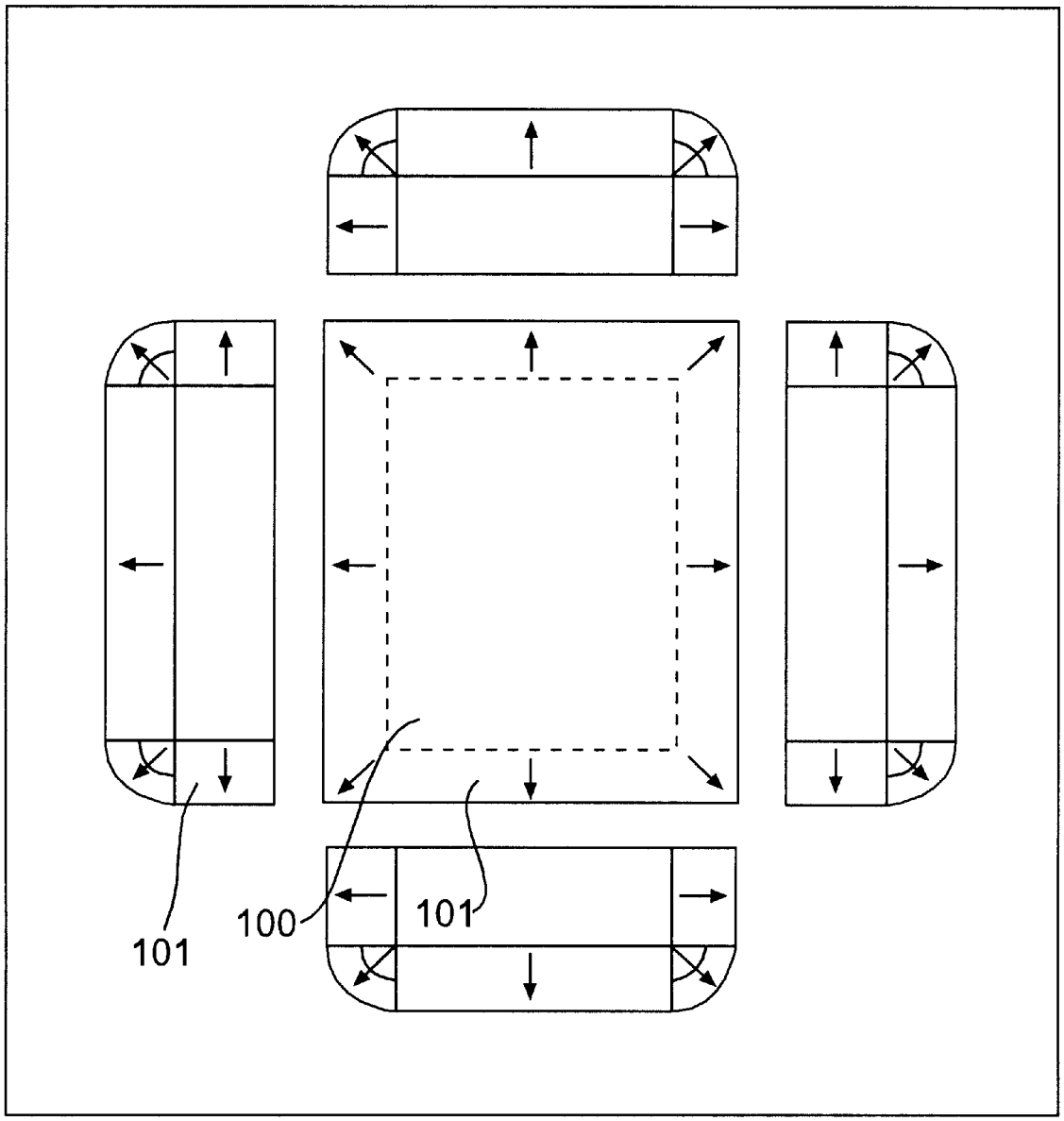
FIG. 11 shows another preferred embodiment of the present invention.

When the initial strain is applied to this portion, the above-mentioned problem can be slightly reduced. The smooth change of Young's moduli in the respective directions is to solve this problem. As shown in FIGS. 9 and 10, both sides of the apertures formed in the region 102 around the circumference of the effective face area are treated with the tie bar grading in order to make the changes in Young's modulus gradual. The effective face area of the mask is rounded to remove stress concentrations at the corners.

As illustrated in FIG. 7, fiducial apertures 104 which may be used as the standard to determine the stretch on the mask, are circular and located in the region with apertures of the extending region 101 beyond the effective face area. The stretch strain is determined and applied to the mask based on these apertures 104.

It is effective to apply the force in all directions in the mask stretching. Even though the displacement is fixed to make two sides perpendicular to the strain application direction, because the fiducial apertures move, they should be formed all the places in order to recognize the correct value. Therefore, preferably, apertures 104 three or more on each side.

It will be apparent to those skilled in the art that various modifications and variations can be made in the shadow mask of the present invention and in construction of this shadow mask without departing from the scope or spirit of the invention. For example, (a) the tie bar grading in the secondary ineffective face area may be toward or away from the effective face area; (b) the tie bar grading in the secondary ineffective face area or the primary ineffective area may be in a vertical direction; (c) the tie bar grading in the primary ineffective face area may be in a radial direction toward or away from the center of the primary ineffective face area or in a radial direction toward or away from the center of the effective face area; (d) the tie bar grading in the primary ineffective face area may be toward or away from the effective face area; (e) the primary ineffective face area may have a tie bar grading toward or away from the primary effective area; (f) the primary ineffective face area has a tie bar grading that decreases and then increases from the effective area side to the side away from the effective area; (g) the primary ineffective face area has a tie bar grading that increases and then decreases from the effective area side to the side away from the effective area; and (h) the corners of the primary ineffective face area and the secondary ineffective face area are rounded.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A shadow mask for a cathode ray tube, comprising:

an effective face area having a plurality of apertures and constituting a central portion of the shadow mask for receiving electron beams;

a secondary ineffective face area having a plurality of apertures and surrounding said effective face area, said secondary ineffective face area receiving no electron beams; and a frame attaching border surrounding said secondary ineffective face area for attaching said shadow mask to a front panel of the cathode ray tube.

2. The shadow mask as claimed in claim 1, further comprising a primary ineffective face area having a plurality of apertures, at least partially surrounding said frame attaching border, and receiving no electron beams.

3. The shadow mask as claimed in claim 1, wherein said secondary ineffective face area includes one or more fiducial apertures, and wherein said fiducial apertures have a strain stretch to use as a standard for measuring stretching of said mask.

4. The shadow mask as claimed in claim 1, wherein said secondary ineffective face area has a round corner.

5. The shadow mask as claimed in claim 1 wherein a tie bar distance between two adjacent apertures in said secondary ineffective face area varies in a vertical direction.

6. The shadow mask as claimed in claim 1, wherein said secondary ineffective face area has a tie bar grading in a direction away from said effective face area such that a tie bar distance between two adjacent apertures in said secondary ineffective area varies in said direction away from said effective face area.

7. The shadow mask as claimed in claim 2, further comprising one or more corner portions adjacent said primary ineffective face area and having no apertures.

8. The shadow mask as claimed in claim 2, wherein said primary ineffective face area includes an inside region and an outside region surrounding said inside region, and wherein a tie bar distance between two adjacent apertures in said inside region is uniform and wherein a tie bar distance between two adjacent apertures in said outside region varies in a direction away from said effective face area.

9. The shadow mask as claimed in claim 2, wherein said primary ineffective face area has a round corner.

10. The shadow mask as claimed in claim 2, wherein a tie bar distance between two adjacent apertures in said primary ineffective face area varies in a vertical direction.

11. The shadow mask as claimed in claim 2, wherein said primary ineffective face area has a tie bar grading in a radial direction away from said effective face area such that a tie bar distance between two adjacent apertures in said primary ineffective face area varies in a radial direction away from said effective face area.

12. The shadow mask as claimed in claim 2, wherein said primary ineffective face area includes an inside region and an outside region surrounding said inside region and wherein said primary ineffective face area has a tie bar grading in a radial direction away from a center of said inside region such that a tie bar distance between two adjacent apertures in said primary ineffective face area varies in said radial direction away from said center of said inside region.

13. The shadow mask as claimed in claim 2, wherein said primary ineffective face area has a tie bar grading in a direction toward said effective face area such that a tie bar distance between two adjacent apertures in said primary ineffective face area increases in said direction toward said effective face area.

14. The shadow mask as claimed in claim 2, wherein said primary ineffective face area includes an internal region adjacent to said effective area and an external region adjacent to said internal region and away from said effective area, said external region having a tie bar grading such that a tie bar distance between two adjacent apertures in said external region varies in a direction away from said effective area.

15. The shadow mask as claimed in claim 2, wherein said primary ineffective face area includes an inside region and an outside region surrounding said inside region, and wherein a tie bar distance between two adjacent apertures in said outside region varies in a direction away from a center of said inside region.

16. The shadow mask as claimed in claim 2, wherein said primary ineffective face area includes an inside region and an outside region surrounding said inside region, and wherein a tie bar distance between two adjacent apertures in said inside region varies in a direction away from a center of said inside region.

17. The shadow mask as claimed in claim 2, wherein said primary ineffective face area includes an inside region and an outside region surrounding said inside region, and wherein a tie bar distance between two adjacent apertures in said primary ineffective face area increases in a radial direction away from a center of said inside region.

18. The shadow mask as claimed in claim 2, wherein said primary ineffective face area includes an inside region and an outside region surrounding said inside region, wherein a tie bar distance between two adjacent apertures in said primary ineffective face area decreases in a radial direction away from a center of said inside region.

19. A shadow mask for a cathode ray tube, comprising:

an effective face area having a plurality of apertures and constituting a central portion of the shadow mask for receiving electron beams;

a secondary ineffective face area having a plurality of apertures and surrounding said effective face area, said secondary ineffective face area receiving no electron beams and having a corner part, wherein a tie bar distance between two adjacent apertures in said corner part varies in a radial direction away from a center of said effective face area; and a frame attaching border surrounding said secondary ineffective face area for attaching said shadow mask to a front panel of the cathode ray tube.

20. The shadow mask as claimed in claim 19, further comprising a primary ineffective face area having a plurality of apertures, at least partially surrounding said frame attaching border, and receiving no electron beams.

21. The shadow mask as claimed in claim 19, wherein said secondary ineffective face area has a tie bar grading in a direction away from said effective face area such that a tie bar distance between two adjacent apertures in said secondary ineffective area varies in said direction away from said effective face area.

22. The shadow mask as claimed in claim 19, wherein said secondary ineffective face area has a round corner.

23. The shadow mask as claimed in claim 19, wherein said secondary ineffective face area includes one or more fiducial apertures, and wherein said fiducial apertures include a strain stretch to use as a standard for measuring stretching of said mask.

24. The shadow mask as claimed in claim 20, further comprising one or more corner portions adjacent said primary ineffective area and having no apertures.

25. The shadow mask as claimed in claim 20, wherein a tie bar distance between two adjacent apertures in said primary ineffective face area varies in a vertical direction.

26. The shadow mask as claimed in claim 20, wherein said primary ineffective face area includes an inside region and an outside region surrounding said inside region, wherein a tie bar distance between two adjacent apertures in said inside region is uniform and wherein a tie bar distance between two adjacent apertures in said outside region varies in a direction away from said effective face area.

27. The shadow mask as claimed in claim 20, wherein said primary ineffective face area has a round corner.

28. The shadow mask as claimed in claim 20, wherein said primary ineffective face area has a tie bar grading in a radial direction away from said effective face area such that a tie bar distance between two adjacent apertures in said primary ineffective face area varies in a radial direction away from said effective face area.

29. The shadow mask as claimed in claim 20, wherein said primary ineffective face area includes an inside region and an outside region surrounding said inside region and wherein said primary ineffective face area has a tie bar grading in a radial direction away from a center of said inside region such that a tie bar distance between two adjacent apertures in said primary ineffective face area varies in said radial direction away from said center of said inside region.

30. The shadow mask as claimed in claim 20, wherein said primary ineffective face area has a tie bar grading in a direction toward said effective face area such that a tie bar distance between two adjacent apertures in said primary ineffective face area increases in said direction toward said effective face area.

31. The shadow mask as claimed in claim 20, wherein said primary ineffective face area includes an internal region adjacent to said effective area and an external region adjacent to said internal region and away from said effective area, and said external region having a tie bar grading such that a tie bar distance between two adjacent apertures in said external region varies in a direction away from said effective area.

32. The shadow mask as claimed in claim 20, wherein said primary ineffective face area includes an inside region and an outside region surrounding said inside region, wherein a tie bar distance between two adjacent apertures in said outside region varies in a direction away from a center of said inside region.

33. The shadow mask as claimed in claim 20, wherein said primary ineffective face area includes an inside region and an outside region surrounding said inside region, wherein a tie bar distance between two adjacent apertures in said inside region varies in a direction away from a center of said inside region.

34. The shadow mask as claimed in claim 20, wherein a tie bar distance between two adjacent apertures in said primary ineffective face area varies in a vertical direction.

35. The shadow mask as claimed in claim 20, wherein a tie bar distance between two adjacent apertures in said secondary ineffective face area varies in a vertical direction.

36. The shadow mask as claimed in claim 20, wherein said primary ineffective face area includes an inside region and an outside region surrounding said inside region, wherein a tie bar distance between two adjacent apertures in said primary ineffective face area increases in a radial direction away from a center of said inside region.

37. The shadow mask as claimed in claim 20, wherein said primary ineffective face area includes an inside region and an outside region surrounding said inside region, wherein a tie bar distance between two adjacent apertures in said primary ineffective face area decreases in a radial direction away from a center of said inside region.

38. A shadow mask for a cathode ray tube, comprising:

an effective face area having a plurality of apertures and constituting a central portion of the shadow mask;

a secondary ineffective face area having a plurality of apertures and surrounding said effective face area, said secondary ineffective face area receiving no electron beams;

a frame attaching border surrounding said secondary ineffective face area for attaching said shadow mask to a front panel of the cathode ray tube;

a primary ineffective face area at least partially surrounding said frame attaching border;

a first blank region between said primary and secondary ineffective face areas, said first blank region having no apertures;

a second blank region outside said primary ineffective face area; and a third blank region constituting one or more corner portions and adjacent said primary ineffective face area, said third blank region having no apertures.

39. The shadow mask as claimed in 38, wherein said primary ineffective face area has a plurality of apertures.

40. The shadow mask as claimed in claim 38, wherein said secondary ineffective face area has a round corner.

41. The shadow mask as claimed in claim 38, wherein a tie bar distance between two adjacent apertures in said secondary ineffective face area varies in a vertical direction.

42. The shadow mask as claimed in claim 39, wherein said primary ineffective face area has a tie bar grading toward said first blank region such that a tie bar distance between two adjacent apertures in said primary ineffective face area varies in a direction toward said first blank region.

43. The shadow mask as claimed in claim 39, wherein a tie bar distance between two adjacent apertures in said primary ineffective face area is uniform and wherein a tie bar distance between two adjacent apertures in said second blank region varies in a direction away from said effective face area.

44. The shadow mask as claimed in claim 39, wherein said primary ineffective face area has a round corner.

45. The shadow mask as claimed in claim 39, said primary ineffective face area has a tie bar grading in a radial direction away from said effective face area such that a tie bar distance between two adjacent apertures in said primary ineffective face area varies in a radial direction away from said effective face area.

46. The shadow mask as claimed in claim 39, wherein said primary ineffective face area includes an inside region and an outside region surrounding said inside region and wherein said primary ineffective face area has a tie bar grading in a radial direction away from a center of said inside region such that a tie bar distance between two adjacent apertures in said primary ineffective face area varies in said radial direction away from said center of said inside region.

47. The shadow mask as claimed in claim 39, wherein said primary ineffective face area has a tie bar grading toward said first blank region such that a tie bar distance between two adjacent apertures in said primary ineffective face area varies in a direction toward said first blank region.

48. The shadow mask as claimed in claim 39, wherein a tie bar distance between two adjacent apertures in said primary ineffective face area decreases and then increases from said first blank region to said second blank region.

49. The shadow mask as claimed in claim 39, wherein a tie bar distance between two adjacent apertures in said primary ineffective face area increases and then decreases from said first blank region to said second blank region.

50. The shadow mask as claimed in claim 39, wherein said secondary ineffective face area includes one or more fiducial apertures, and wherein said fiducial apertures include a strain stretch to use as a standard for measuring stretching of said mask.

51. A shadow mask for a cathode ray tube, comprising:

an effective face area having a plurality of apertures and constituting a central portion of the shadow mask for receiving electron beams;

a frame attaching border surrounding said effective face area for attaching said shadow mask to a front panel of the cathode ray tube;

an ineffective face area at least partially surrounding said frame attaching border and receiving no electron beams;

a first blank region between said effective face area and said ineffective face area;

a second blank region surrounding said ineffective face area, said second blank region having no apertures; and a third blank region constituting one or more corner portions of said shadow mask and adjacent to said ineffective face area, said third blank region having no apertures.

52. The shadow mask as claimed in claim 51, wherein said ineffective face area and said first blank region have apertures.

53. The shadow mask as claimed in claim 51, wherein a portion between said effective face area and said frame attaching border includes one or more fiducial apertures, and wherein said fiducial apertures include a strain stretch to use as a standard for measuring stretching of said mask.

54. The shadow mask as claimed in claim 52, wherein a tie bar distance between two adjacent apertures in said ineffective face area varies in a direction toward said first blank region.

55. The shadow mask as claimed in claim 52, wherein said ineffective face area includes an inside region and an outside region surrounding said inside region, wherein a tie bar distance between two adjacent apertures in said inside region is uniform and wherein a tie bar distance between two adjacent apertures in said outside region varies in a direction away from said effective face area.

56. The shadow mask as claimed in claim 52, wherein said ineffective face area has a round corner.

57. The shadow mask as claimed in claim 52, wherein a tie bar distance between two adjacent apertures in said ineffective face area varies in a direction toward said first blank region.

58. The shadow mask as claimed in claim 52, wherein a tie bar distance between two adjacent apertures in said ineffective face area varies in a radial direction away from said effective face area.

59. The shadow mask as claimed in claim 52, wherein a tie bar distance between two adjacent apertures in said ineffective area varies in a direction toward said second blank region.

60. The shadow mask as claimed in claim 52, wherein said ineffective face area includes an inside region and an outside region surrounding said inside region, wherein a tie bar distance between two adjacent apertures in said primary ineffective face area increases in a radial direction away from a center of said inside region.

61. The shadow mask as claimed in claim 52, wherein said ineffective face area includes an inside region and an outside region surrounding said inside region, wherein a tie bar distance between two adjacent apertures in said primary ineffective face area decreases in a radial direction away from a center of said inside region.

* * * * *